United States Patent [19]

Itoh et al.

[11] Patent Number: 5,032,761

[45] Date of Patent: Jul. 16, 1991

[54] ELECTRON FEED STRUCTURE FOR FLAT-TYPE LUMINOUS DEVICE

[75] Inventors: Shigeo Itoh; Kazuhiko Tsuburaya; Mikio Yokoyama, all of Mobara, Japan

[73] Assignee: Futaba Denshi Kogyo K.K., Mobara, Japan

[21] Appl. No.: 500,598

[22] Filed: Mar. 28, 1990

[30] Foreign Application Priority Data

Mar. 28, 1989 [JP] Japan ..... 1-035138

[51] Int. Cl.[5] ..... H01J 29/74

[52] U.S. Cl. ..... 313/495; 313/422; 313/432

[58] Field of Search ..... 313/422, 495, 432

[56] References Cited

U.S. PATENT DOCUMENTS 4,137,478 1/1979 Credelle ..... 313/422

4,153,856 5/1979 Siekanowicz et al. ..... 313/422

*Primary Examiner*—Palmer C. DeMeo

*Attorney, Agent, or Firm*—Oblon, Spivak, McClelland, Maier & Neustadt

[57] ABSTRACT

An electron feed structure for a flat-type luminous device capable of permitting electron emitted from an electrons source to be uniformly fed throughout a display section. The electron feed structure includes an electron flow guide constituted by an inner guide electrode of a high voltage and an outer guide electrode of a low voltage, so that an electric field of a high voltage and that of a low voltage may be alternately formed to form electrostatic lenses in the guide, to thereby effectively prevent the function of the electron flow guide from being deteriorated. A guide voltage applied to each of the electrode segments of the inner guide electrode is rendered constant and a guide voltage applied to each of the electrode segments of the outer guide electrode is likewise rendered constant, to thereby cause the correlation between the guide voltage and a deflection voltage applied to the electron flow guide to be uniform irrespective of a position within the electron flow guide, resulting in electrons emitted from the electron source being drawn out under the same conditions.

4 Claims, 4 Drawing Sheets

ELECTRON FEED STRUCTURE FOR FLAT-TYPE LUMINOUS DEVICE

BACKGROUND OF THE INVENTION

This invention relates to an electron feed structure for a flat-type luminous device, and more particularly to an electron feed structure for a flat-type luminous device adapted to display a picture image or a projected image or be used as a back light for a non-luminous display device such as a liquid crystal display device.

Conventionally, a CRT has been generally used for a character display device, a graphic display device, an image display device or the like. Unfortunately, the CRT has a disadvantage that its construction renders the thinning and/or weight-saving of a display device highly difficult. In order to solve such a problem, a flat-type luminous device was proposed which is constructed in such a manner as disclosed in Japanese Patent Application No. 200342/1988. The proposed luminous device includes an electron source arranged at the end of the luminous device and an electron feed structure comprising an electron flow guide for guiding electrons emitted from the electron source to a position opposite to a display section.

FIGS. 4(*a*) and 4(*b*) show an example of such a conventional flat-type luminous device, wherein FIG. 4(*a*) is a sectional view of the device and FIG. 4(*b*) shows an electron feed structure arranged in the device. More particularly, the flat-type luminous device generally designated at reference numeral I includes a front cover 1 made of a light-permeable insulating material such as glass or the like, a rear plate 3 made of a glass plate or the like and positioned opposite to the front cover 1 and side plates 11, which are joined together by means of a sealing material 12 such as a low-melting flit glass or the like to form an air-tight envelope.

On the inner surface of the front cover 1 is arranged a display section 2 comprising phosphor layers of desired luminous colors and anode conductors serving also as an accelerating electrode. On the inner surface of the rear plate 3 opposite to the inner surface of the front cover 1 is arranged an electron source A. Also, an electron flow guide B for guiding electrons emitted from the electron source is arranged in the envelope in a manner to be opposite to the display section 2. Between the electron flow guide B and the display section 2 is a selecting electrode section 13 for more finely carrying out the positional selection of electrons drawn out of the electron flow guide B.

The electron source A includes a filamentary cathode 4 for emitting electrons which is stretchedly arranged so as to extend along one side of the envelope, a reflecting electrode 5 arranged adjacent to the filamentary cathode 4 and serving to force out electrons emitted from the filamentary cathode 4 toward the electron flow guide B, and a combination of a drawing-out electrode 6 and a focusing electrode 7 arranged opposite to the reflecting electrode 5 with the filamentary cathode 4 being interposed between the reflecting electrode 5 and the combination and serving to draw out and focus electrons emitted from the filamentary cathode 4 to introduce the electrons into the electron flow guide B. The electron flow guide B, when it is applied to a flat-type display device, includes a front electrode 8 divided into a plurality of electrode segments in the direction of traveling of electrons emitted from the electron source A and formed with mesh-like openings and a rear electrode 9 made of a flat metal plate and divided into a plurality of electrode segments in the direction of traveling of the electrons. The electrode segments of the front electrode 8 and rear electrode 9 are arranged parallel to one another and opposite to one another at the same intervals. The electrode segments of each of the front electrode 8 and rear electrode 9 are separated, depending upon a voltage applied thereto, into a guide electrode section to which a guide voltage is applied and a deflecting electrode section to which a deflecting voltage is applied. Also, the electrode segments of the front electrode 8 and rear electrode 9 serve as both electrode sections depending upon the position selected.

Now, the manner of operation of the conventional electron feed structure constructed as described above will be described hereinafter with reference to FIGS. 4(*a*) and 4(*b*).

The electrodes constituting the electron source A each have applied thereto a predetermined voltage of, for example, 100 V or less, resulting in electrons being drawn therefrom. In the electron flow guide B, each opposite two of the electrode segments of the front electrode 8 and rear electrode 9 constituting the guide electrode sections form each set. The so-formed electrode sets have alternately applied thereto a low voltage L of, for example, 20 V and a high voltage H of, for example, 100 V from the side of the electron source A. This causes an electrostatic lens to be formed at the boundary between the focusing electrode 7 of the electron source A and the electrode segments of the front electrode 8 and rear electrode 9 nearest the electron source A in the electron flow guide B. Likewise, in the electron flow guide B, an electrostatic lens is formed at each of the boundary of each front electrode 8 and the boundary of each rear electrode 9. The so-formed electrostatic lenses serve to guide electrons emitted from the electron source A toward the other end of the electron flow guide B without diffusing the electrons and while ensuring focusing of the electrons.

The deflection of electrons traveling in the electron flow guide B toward the display section is carried out by causing the electrode segments 8*b* and 9*a* of the front electrode 8 and rear electrode 9 positioned in proximity to the position of the display section to be selected and farther away from the electron source A to serve as a deflecting electrode section. More particularly, at least one of the application of a deflection voltage L' of a level equal to or lower than the low voltage L applied to the guide electrode section such as, for example, 0 V to the electrode segments 9*a* of the rear electrode 9 and the application of a deflection voltage H' of a level equal to or higher than the high voltage H applied to the guide electrode section to the electron segments 8*a* of the front electrode 8 positioned in proximity to the position of the display section selected causes the electrons traveling in the electron flow guide, while being focused to be deflected toward the display section 2.

In the conventional flat-type luminous device constructed as described above, in the case that a deflection voltage is applied to the electrodes of the electron flow guide B, a guide voltage applied to the guide electrode section adjacent to the deflecting electrode section is either the high voltage H or the low voltage L depending upon the position of the electrode selected.

This will be more detailedly described with reference to FIGS. 5(*a*) and 5(*b*) each of which is a graphical representation showing the analysis of an electric field obtained by applying the deflection voltage L' to the electron flow guide to deflect the electrons. When the position of the display section corresponding to the electrode segment 8' of the front electrode 8 is to be selected, a deflection voltage of, for example, 0 V is applied as a guide voltage to the electrode segment 8a of the front electrode 8 farther away from the electron source A and the electrode segment 9a of the rear surface 9 positioned opposite to the front electrode segment 8' and farther away than the electrode piece 8' from the electron source A, and the high voltage H of, for example, 100 V and the low voltage L of, for example, 30 V are alternately applied as a guide voltage to the electrode segments 8, 8' and 9 of the front electrode and rear electrode.

At this time, in the case shown in FIG. 5(a), a guide voltage of 100 V is applied to the electrode segment 8 of the front electrode, so that electrons emitted from the electron source is caused to concentrically flow toward the electrode segment 8' of the front electrode. In contrast with FIG. 5(a), when the portion of the display section corresponding to the electrode segment 8' of the front electrode defined one position this side of the electron source is selected, a guide voltage of 30 V is applied to the electrode segment 8' of the front electrode. This permits electrons emitted from the electron source to flow toward the electrode segment 8 of the front electrode because the guide voltage of 100 V is applied thereto, although a part of the electrons flow toward the electrode segment 8' of the front electrode.

Thus, the application of the guide voltage and deflection voltage to the electron flow guide as described above causes both the application of the high voltage H to the electrode segment 8' of the front electrode and the application of the low voltage thereto. This causes the correlation between the guide voltage and the deflection voltage around the position of the electron flow guide B selected to be varied depending upon the position, resulting in varying the amount of electrons drawn toward the display section. Also, this leads to a disadvantage of varying the focusing of electrons near the electrode segment 8' of the front electrode.

Further, such disadvantages are encountered when the deflection voltage H' is applied to the electrode segment 8a of the front electrode positioned near the position of the electron flow guide selected, because the correlation between the guide voltage and the deflection voltage is varied depending upon the position.

SUMMARY OF THE INVENTION

The present invention has been made in view of the foregoing disadvantages of the prior art.

Accordingly, it is an object of the present invention to provide an electron feed structure for a flat-type luminous device which is capable of permitting electrons to be uniformly fed throughout a display section.

In accordance with the present invention, there is provided an electron feed structure for a flat-type luminous device which includes an air-tight envelope which is evacuated to a high vacuum and in which various electrodes are arranged, a display section arranged in the envelope and comprising phosphor layers adapted to emit light upon impingement of electrons thereon, anode conductors, and a selecting electrode section and an accelerating electrode section for selecting and controlling an electron beam discharged from the electron feed structure to selectively impinge the electron beam on the phosphor layers of the display section. The electron feed structure comprises at least one electron source and at least one electron flow guide for guiding electrons emitted from the electron source along a plane opposite to the display section. The electron flow guide comprises an inner guide electrode comprising a plurality of electrode segments separated from one another in the direction of traveling of the electrons emitted from the electron source and arranged opposite to one another to guide the electrons and an outer guide electrode formed into an integral construction or comprising a plurality of electrode segments separated from one another in the direction of traveling of the electrons. The outer guide electrode is arranged so as to interpose the inner guide electrode therebetween. The inner guide electrode and outer guide electrode have applied thereto guide voltages different from each other to guide the electrons along the electron flow guide, respectively, and at least one of the electrode segments of at least one of the inner guide electrode and outer guide electrode which is positioned in proximity to the position of the display section selected has applied thereto a deflection voltage to deflect and guide the electrons from the electron feed structure to the display section.

As described above, in the electron feed structure of the present invention, the electron flow guide is formed of the high voltage electrode group and the low voltage electrode group into a dual construction. Such a construction permits an electric field of a high voltage and that of a low voltage to be apparently alternately formed to form electrostatic lenses, to thereby effectively prevent the function of the electron flow guide from being deteriorated. A guide voltage applied to each of the electrode segments of the inner guide electrode is rendered constant and a guide voltage applied to each of the electrode segments of the outer guide electrode is likewise rendered constant, so that the correlation between the guide voltage and the deflection voltage applied to the electron flow guide is caused to be uniform irrespective of a position within the electron flow guide, resulting in electrons emitted from the electron source being drawn out under the same conditions.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference characters designated like or corresponding parts throughout; wherein.

DETAILED DESCRIPTION OF THE PREFERRED EMBODIMENTS

Now, an electron feed structure for a flat-type luminous device according to the present invention will be described hereinafter with reference to FIGS. 1(*a*) to 3.

Figure 1:
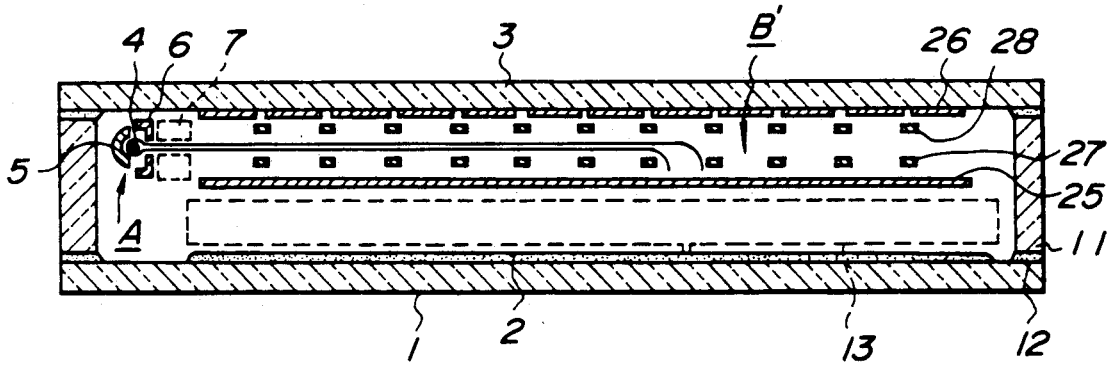
FIG. 1(a) is a vertical sectional view showing a flat-type luminous device in which an embodiment of an electron feed structure according to the present invention is incorporated.
FIG. 1(b) is a fragmentary vertical sectional view showing an essential part of the electron feed structure of FIG. 1(a)
Figure 1:
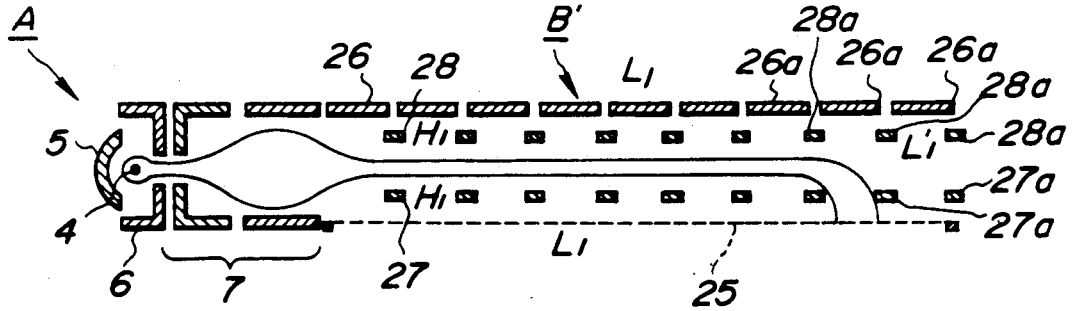

FIGS. 1(*a*) and 1(*b*) show an embodiment of an electron feed structure for a flat-type luminous device according to the present invention. An electron feed structure of the illustrated embodiment generally includes an electron source A and an electron flow guide B'. The electron flow guide B' includes an outer guide electrode comprising an outer front electrode 25 and an outer rear electrode 26 and an inner guide electrode comprising an inner front electrode 27 and an inner rear electrode 28 which are interposed between the outer front electrode 25 and the outer rear electrode 26.

More particularly, the outer front electrode 25 is positioned opposite to a display section 2 and made of a single metal plate formed with a plurality of openings of a mesh-like shape, a slit-like shape or the like. Alternatively, it may be made of a plurality of metal plates electrically connected integral with each other. The outer rear electrode 26 is formed by depositing a conductive film directly on a rear plate 3 or arranging a metal plate on or in proximity to the rear plate 3 and is divided into a plurality of rear electrode segments in the direction of traveling of electrons emitted from the electron source A.

The inner front electrode 27 and inner rear electrode 28 comprise a plurality of strip-like or rod-like electrode segments arranged opposite to each other. The electrode segments of each of the electrodes 27 and 28 are arranged in a manner to be spaced from one another at intervals equal to those of arrangement of the electrode segments of the outer rear electrode 26 and opposite to gaps between the respective adjacent two electrode segments of the outer rear electrode 26.

In the electron flow guide B' constructed as described above, the outer front electrode 25 and outer rear electrode 26 each have constantly applied thereto a low voltage $L_1$ of, for example, 30 V serving as a guide voltage, whereas the inner front electrode 27 and inner rear electrode 28 each are applied thereto a high voltage $H_1$ of, for example, 100 V serving as a guide voltage. This causes a high voltage region and a low voltage region to be alternately formed in the electron flow guide B', resulting in electrostatic lenses being formed in the electron flow guide B', so that electrons emitted from the electron source A may travel while being focused in the electron flow guide.

When the electrons are to be deflected toward the display section 2 from the electron flow guide B', a deflection voltage $L_1'$ of, for example, 0 V, which is lower than the low voltage $L_1$, is applied to electrode segments 26*a* of the outer rear electrode 26 positioned in proximity to the position of the electron flow guide B' selected and electrode segments 26*a* of the outer rear electrode 26 positioned farther away from the selected position of the electron flow guide B' in the direction of traveling of the electrons, as well as electrode segments 27*a* and 28*a* of the inner front and rear electrodes 27 and 28 positioned farther away from the selected position of the electron flow guide B' in the traveling direction of the electrons, as shown in FIG. 1(*b*). This causes the electrons to be deflected toward the display section 2, which are subsequently subject to positional selection by means of a selecting electrode or the like, leading to impingement on a predetermined position of the display section. This results in a desired luminous display being obtained.

Figure 2:
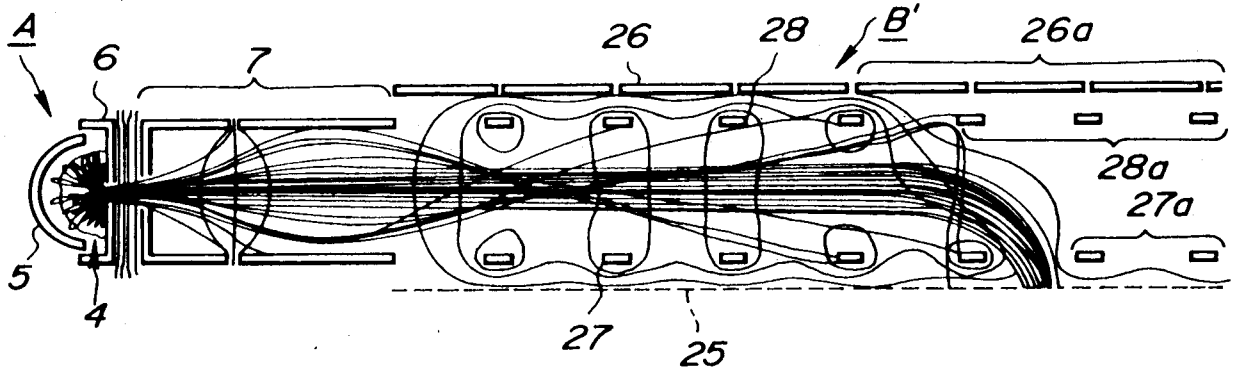
FIG. 2 is a graphical representation showing the analysis of an electric field generated by the electron feed structure shown FIG. 1(a)

FIG. 2 shows the analysis of an electric field generated from the electron feed structure of the illustrated embodiment, which is obtained by applying the guide voltage and deflection voltage to the electrodes of the electron flow guide B'.

As will be noted from FIG. 2, the application of the guide voltage permits the electrostatic lenses to be formed due to the cooperation between the outer front electrode 25 and the outer rear electrode 26 and between the inner front electrode 27 and the inner rear electrode 28, resulting in electrons emitted from the electron source A traveling while being focused in the electron flow guide B'. Also, the application of the deflection voltage causes the electrons to be deflected toward the display section 2.

As can be seen from the foregoing, in the electron feed structure of the illustrated embodiment, the application of the deflection voltage $L_1'$ to the electrode segments 26*a*, 27*a* and 28*a* of the outer rear electrode 26, inner front electrode 27 and inner rear electrode 28 for the purpose of deflecting electrons emitted from the electron source A toward the display section 2 permits the correlation between the voltages applied to the electrode segments of the electrodes constituting the electron flow guide B' positioned in proximity to the position of the guide B' selected to be kept constant irrespective of the selected position of the electron flow guide B'.

Thus, the electron feed structure of the illustrated embodiment permits the correlation between the guide voltage and the deflection voltage applied to the electron flow guide B' to be kept constant irrespective of the position within the electron flow guide B', so that electrons emitted from the electron source may be drawn out of the electron flow guide B' constantly under the same conditions. Thus, the illustrated embodiment exhibits an advantage of permitting the amount and focusing of electrons drawn out of the electron flow guide B' to be rendered much more uniform. This contributes to the elimination of nonuniformity in the display due to a variation in amount of electrons drawn out, leakage of luminance due to deterioration in focusing of the electrons and the like.

Figure 3:
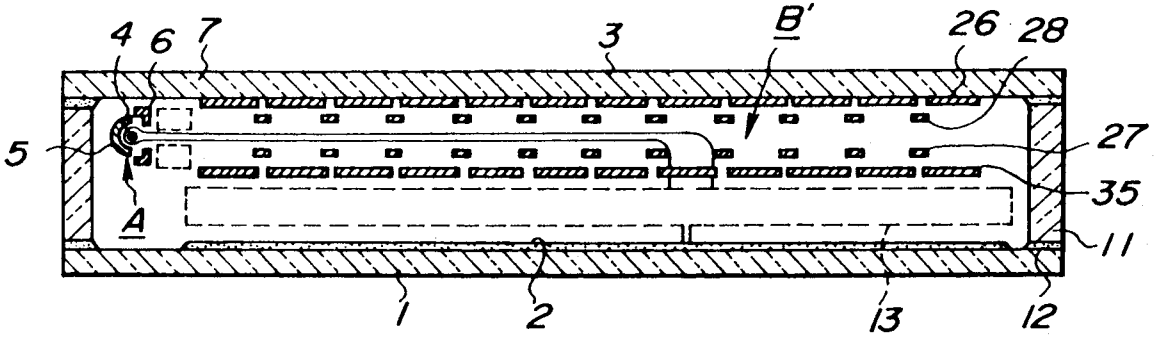
FIG. 3 is a vertical sectional view showing a flat-type luminous device in which another embodiment of an electron feed structure according to the present invention is incorporated.
Figure 4A:
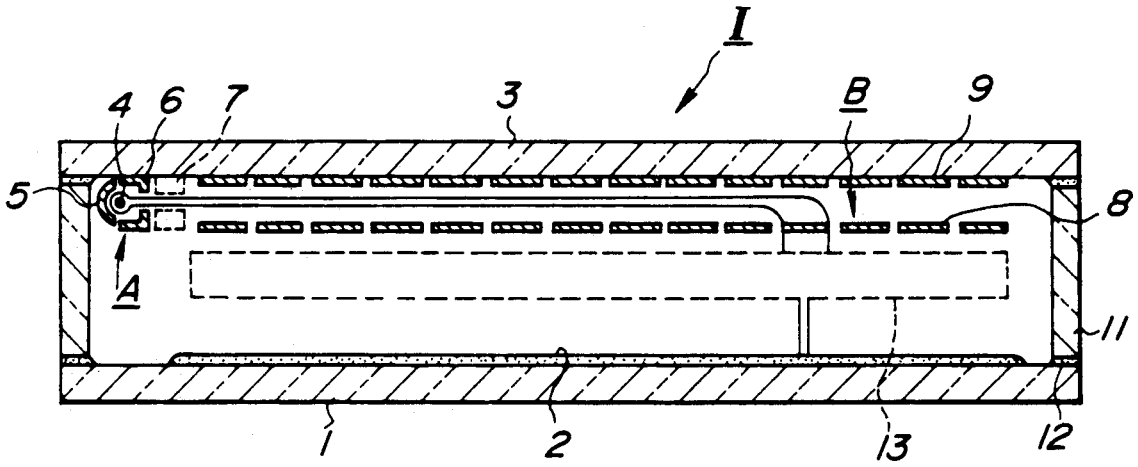
FIG. 4(a) PRIOR ART
FIG. 4(a) is a vertical sectional view showing a flat-type luminous device in which a conventional electron feed structure is incorporated.
Figure 4B:
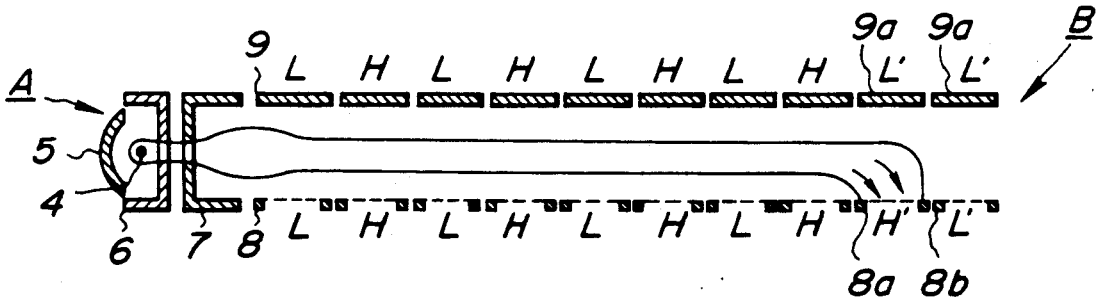
FIG. 4(b) PRIOR ART
FIG. 4(*b*) is a fragmentary sectional view showing an essential part of the conventional electron feed structure of FIG. 4(*a*)
Figure 5A:
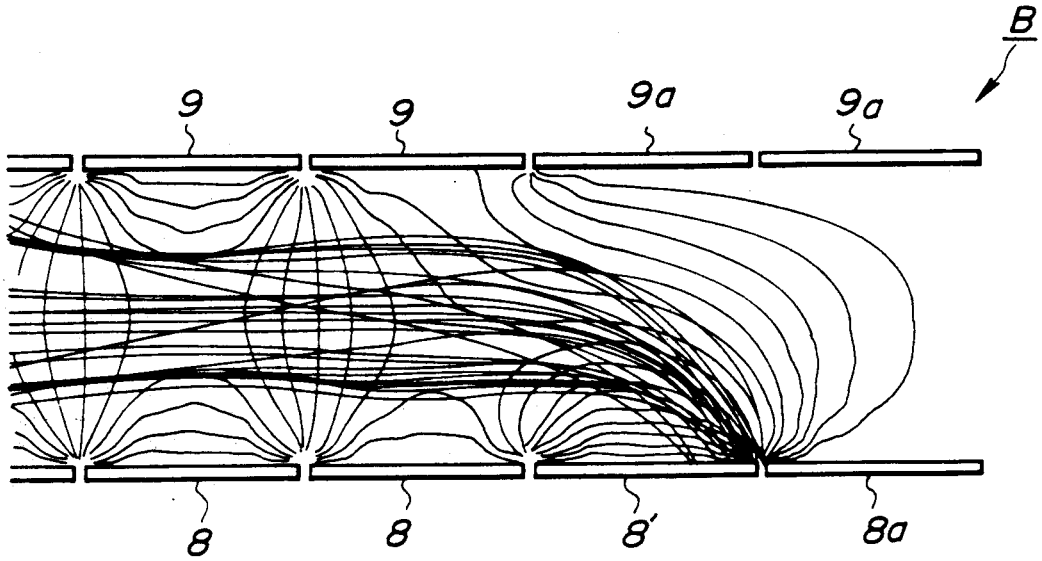
FIG. 5(a) PRIOR ART
FIGS. 5(*a*) and (*b*) each are a graphical representation showing the analysis of an electric field generated by the conventional electron feed structure shown in FIG. 4(*a*).
Figure 5B:
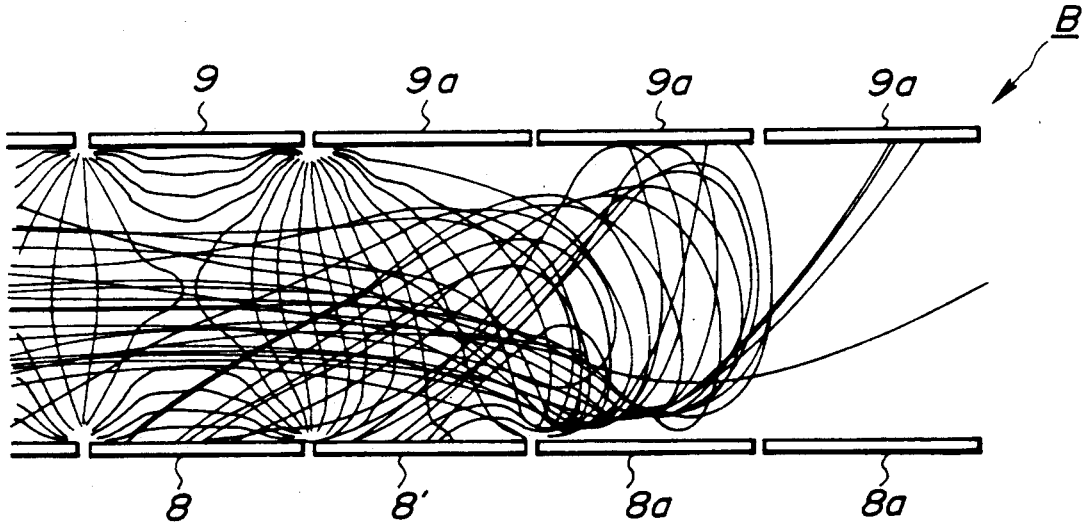
FIG. 5(b) PRIOR ART

In the embodiment described above, the electron flow guide B' includes the outer front electrode 25 which is made of a single metal plate or a plurality of metal plates electrically connected to one another and formed with a plurality of the openings. Alternatively, the electron flow guide may be constructed in such a manner as is shown in FIG. 3. More particularly, in an electron feed structure of FIG. 3, an electron flow guide B' includes an outer front electrode 35 which is electrically divided into a plurality of electrode segments in the direction of traveling of electrons, as in an outer rear electrode 26, and which is formed with a plurality of openings. Such a construction permits a deflection voltage to be applied to the outer front electrode 35, to thereby deflect electrons emitted from an electron source A toward a display section 2 with higher efficiency and accuracy.

Thus, in the electron feed structure of each of the embodiments described above, it will be noted that in the electron flow guide, the deflection voltage applied to the inner front electrode and inner rear electrode and a voltage applied to each of a selecting electrode section 13 and anode conductors of the display section 2 permit electrons emitted from the electron source to be satisfactorily deflected toward the display section 2, whether the outer front electrode and outer rear electrode each are formed into an integral construction or comprise a plurality of electrode segments electrically connected. Also, the electron flow guide may be varied in configuration, arrangement and the like in various ways so far as it is constituted by the inner guide electrode and outer guide electrode and a guide voltage applied to each of the electrodes causes electrostatic lenses to be formed in the electron flow guide.

The above-described embodiments have been described in connection with the construction that the guide voltage of a lower level is applied to the outer guide electrode or the outer front electrode and outer rear electrode and the guide voltage of a higher level is applied to the inner guide electrode or the inner front electrode and inner rear electrode. Alternatively, the present invention may be constructed in such a manner that the guide voltage of a higher level is applied to the outer guide electrode and the guide voltage of a lower level is applied to the inner guide electrode, so far as the guide voltages permit electrostatic lenses to be formed between the electron source and the electron flow guide and in the electron flow guide. Also, when the outer guide electrode is formed of a plurality of electrically divided electrode segments, two or more different kinds of guide voltages may be applied to the outer guide electrode. For example, two different kinds of guide voltages, which are lower than the guide voltage applied to the inner guide electrode, may be applied to the outer guide electrode. Alternatively, two or more different kinds of guide voltages may be applied to the inner guide electrode.

In addition, the application of two or more kinds of deflection voltages to the electron flow guide or the application of the deflection voltage thereto may be determined depending upon a flat-type luminous device to which the electron feed structure of the present invention is to be applied so that the deflection characteristics may be rendered optimum.

The electron feed structure of the present invention may be effectively applied to both a flat-type luminous device of the low-voltage type in which a voltage as low as, for example, several ten to several hundred volts is applied to anode conductors of a display section and a flat-type luminous device of the high-voltage type in which a voltage as high as, for example, several to several ten kilovolts is applied to anode conductors of a display section. Also, the present invention may be applied to a flat-type luminous device which is so constructed that anode conductors of a display section serve as a selecting electrode section as well as an accelerating electrode section to carry out the positional selection by means of only the anode conductors or a combination of the anode conductors with another selecting electrode means. Further, a flat-type luminous device for which the present invention may be used is not limited to a specific electron source structure. For example, the present invention may be applied to a flat-type luminous device in which a number of electron guns used for a CRT or the like are arranged in a row. Thus, it will be understood that the present invention may be widely applied to a flat-type luminous device constructed so as to emit electrons in the form of a flat shape.

As can be seen from the foregoing, the electron feed structure of the present invention is constituted by the electron flow guide including the inner guide electrode comprising the electrode segments arranged opposite to the display section in a manner to be separated from one another in the direction of traveling of electrons emitted from the electron source and opposite to each other so as to guide the electrons and the outer guide electrode formed into an integral or single construction or comprising a plurality of electrode segments separated from one another in the direction of traveling of the electrons and arranged in a manner to be opposite to each other so as to interpose the inner guide electrode therebetween. Also, different guide voltages are applied to the inner guide electrode and outer guide electrode, respectively, so that electrons emitted from the electron source may be guided along the electron flow guide. Also, a deflection electrode is applied to at least one of the electrode segments of at least one of the inner guide electrode and outer guide electrode which is positioned in proximity to a position of the display section selected, so that the electrons may be deflected from the electron feed structure toward the display section.

Such a construction of the present invention permits the correlation between the guide voltage and the deflection voltage applied to the electrode segments of the electrodes of the electron flow guide positioned in proximity to the deflection position to be constant irrespective of a position within the electron flow guide, when the deflection voltage is applied to each of the outer guide electrode and inner guide electrode to deflect the electrons toward the display section. This results in the electrons being drawn out of the electron flow guide under the same conditions irrespective of the position of the guide, so that the amount and focusing of electrons drawn out of the electron flow guide may be rendered much more uniform. Thus, it will be noted that the present invention effectively prevent unevenness in display due to a variation in the amount of electrons, leakage of luminance due to a variation in focusing of electrons and the like.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. An electron feed structure for a flat-type luminous device including an air-tight envelope which is evacuated to a high vacuum and in which various electrodes are arranged, a display section arranged in said envelope and comprising phosphor layers adapted to emit light upon impingement of electrons thereon and anode conductors, and a selecting electrode section an accelerating electrode section for selecting and controlling an electron beam discharged from said electron feed structure to selectively impinge said electron beam on said phosphor layers of said display section, comprising:

at least one electron source; and at least one electron flow guide for guiding electrons emitted from said electron source along a plane opposite to said display section;

said electron flow guide comprising an inner guide electrode comprising a plurality of electrode segments separated from one another in the direction of traveling of said electrons emitted from said electron source and arranged opposite to one another to guide said electrons and an outer guide electrode formed into an integral construction or comprising a plurality of electrode segments separated from one another in the direction of traveling of said electrons, said outer guide electrode being arranged so as to interpose said inner guide electrode therebetween;

said inner guide electrode and outer guide electrode having applied thereto guide voltages different from each other to guide said electrons along said electron flow guide, respectively;

at least one of said electrode segments of an least one of said inner guide electrode and outer guide electrode which is positioned in proximity to a selected position of said display section having applied thereto a deflection voltage to deflect and guide said electrons from said electron feed structure to said display section.

2. An electron feed structure as defined in claim 1, wherein each of said electrode segments constituting said inner guide electrode and outer guide electrode is formed into a substantially flat shape.

3. An electron feed structure as defined in claim 2, wherein a part or all of a portion of at least one of said inner guide electrode and outer guide electrode positioned on the side of said display section is formed with mesh-like or slit-like openings.

4. An electron feed structure as defined in claim 1, wherein a part or all of said electrode segments constituting said inner guide electrode and outer guide electrode is formed into a substantially wire-like shape.

* * * * *